US006226905B1

(12) United States Patent
Osuna

(10) Patent No.: US 6,226,905 B1
(45) Date of Patent: May 8, 2001

(54) IDENTIFICATION BADGE HOLDER

(76) Inventor: Maria M. Osuna, 803 N. Frost, Saginaw, MI (US) 48603

( * ) Notice: Subject to any disclaimer, the term of this patent is extended or adjusted under 35 U.S.C. 154(b) by 0 days.

(21) Appl. No.: 09/351,972

(22) Filed: Jul. 12, 1999

Related U.S. Application Data

(60) Provisional application No. 60/092,664, filed on Jul. 13, 1998.

(51) Int. Cl.[7] ..... A44C 3/00
(52) U.S. Cl. ..... 40/1.6; 40/661.04
(58) Field of Search ..... 40/661.04, 1.5, 40/1.6, 661, 663, 664; 24/13, 3.13, 3.12, 302

(56) References Cited

U.S. PATENT DOCUMENTS 2,441,002 * 5/1948 Berglund ..... 40/1.6
3,277,593 * 10/1966 Jarrett ..... 40/661.04

* cited by examiner

*Primary Examiner*—Cassandra H. Davis
(74) *Attorney, Agent, or Firm*—Reising, Ethington, Barnes, Kisselle, Learman & McCulloch, P.C.

(57) ABSTRACT

The badge holder includes a plate member with a retainer secured to its back side for securing the badge holder to a garment. Indicia on the face of the badge holder indicates the profession of the person wearing the badge holder. One or more apertures can be provided for the attachment of pins to the badge holder. A slot in the plate member adjacent to a plate member edge receives an end member of a clamp secured to an identification badge that identifies the person wearing the badge holder.

7 Claims, 2 Drawing Sheets

IDENTIFICATION BADGE HOLDER

This application claims the benefit of U.S. Provisional Application No.: 60/092,664 Jul. 13, 1998.

TECHNICAL FIELD

This invention relates to an identification badge and more particularly to an identification badge holder. The disclosure incorporates the badge holders and methods disclosed in provisional patent application 60/092,664, filed Jul. 13, 1998, whose priority is claimed for this application.

BACKGROUND OF THE INVENTION

Medical personnel and others wear identification badges with a person's photograph in a plastic case. The individual's name may or may not appear on the photograph. A clothespin type clamping device or other attaching device is generally provided for attaching the identification badge to a person's clothing. These badges have three primary shortcomings. They do not indicate, to the public, the professional status of the individual, written information on the badges adjacent to the individual's photograph can be read only when the badge is within a few feet of the reader and it is difficult to attach the badges to some clothing.

Medical personnel for example frequently wear hospital scrubs in medical facilities. Such clothing generally does not have pockets or collars. The elimination of pockets and collars makes them easier to sterilize and reduces drying time. Without pockets or collars there is no satisfactory place to attach a clothespin type clamping device. If it is attached to a vertical edge of a shirt where the shirt buttons up the front, the badge may be oriented vertically rather than horizontally making it difficult to see the photograph. A clothespin type clamp does not hold well on fabric where there is a tendency to rotate the clamping surfaces relative to the fabric. In addition to hospital scrubs, blouses and pullover shirts without front buttons, pockets or collars are frequently worn. These garments have no place to attach the usual identification badge.

Identification badges are sometimes attached to a chain around a person's neck. With such a chain the badge is never properly oriented and about half the time the photograph faces toward the wearer rather than outward so that it can be seen. In such cases badge wearers have to hold their badges up to be seen. Identification badges are also attached to belts around a person's waist. In this location they are difficult to see and may become covered by a shirttail or a loose fitting shirt.

Photograph identification badges generally do not indicate to the public if the wearer is a doctor, a registered nurse, a medical technician, a janitor, or a clerk from the business office. When badges do indicate professional qualifications, the information is too small to read unless the badge is within three feet or so. It can be unsettling to the public and patients not to know who is providing services and if they have the qualifications to provide needed assistance.

SUMMARY OF THE INVENTION

An object of the invention is to provide an identification badge holder that can be attached to any flat fabric surface and to which an identification badge can be attached. Another object of the invention is to provide an identification badge holder that can be easily removed. A further object of the invention is to provide a badge holder which indicates the occupation or qualifications of the wearer.

The badge holder is a flat plastic member with a one or two prong clutch back pin mechanical fastener for securing the plastic member to a shirt, coat or other piece of clothing. The holder may have the shape of a nurser's cap for example. Information such as RN for registered nurse or MD for a medical doctor can be engraved in the plastic member. Apertures for the attachment of a school pin as well as an aperture for attaching an identification badge are provided in the badge holder. A fabric band or bands indicating the college or university attended by the wearer can be attached to the face of the badge holder.

DESCRIPTION OF THE DRAWINGS

The presently preferred embodiment of the invention is disclosed in the following description and in the accompanying drawings, wherein.

DESCRIPTION OF THE PREFERRED EMBODIMENT

Figure 2:
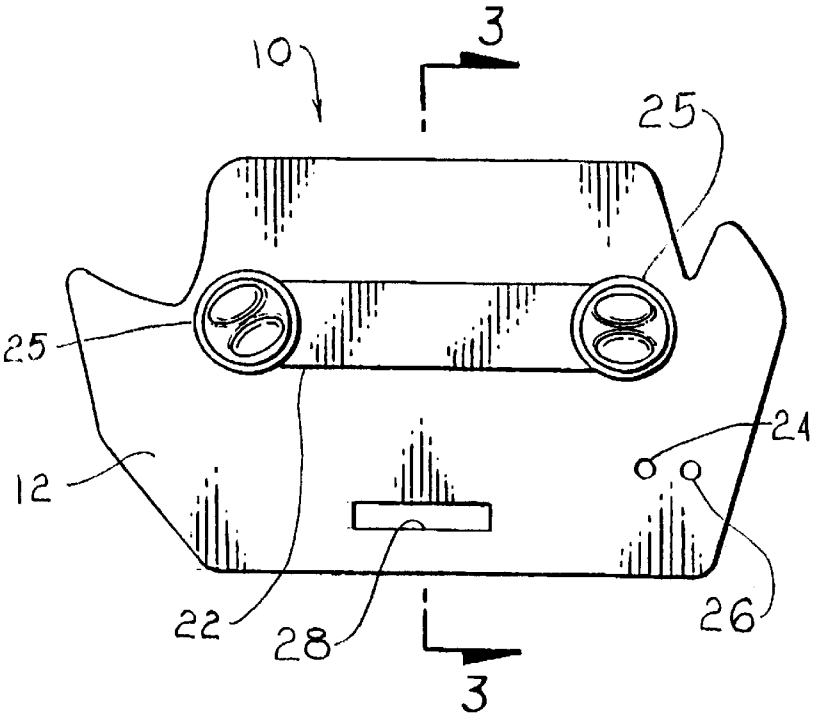
FIG. 2 is a rear elevational view of the identification badge holder.
Figure 3:
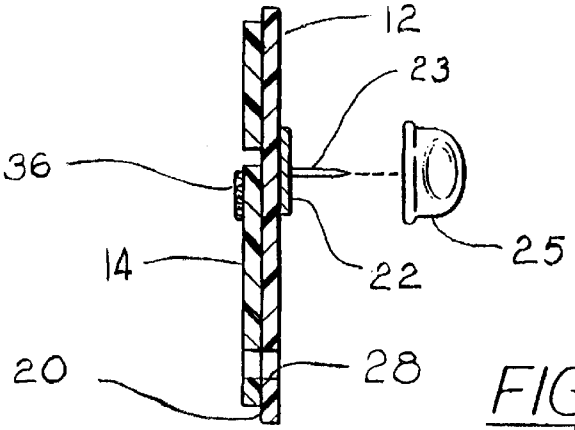
FIG. 3 is a sectional view taken along line 3—3 in FIG. 2.
Figure 1:
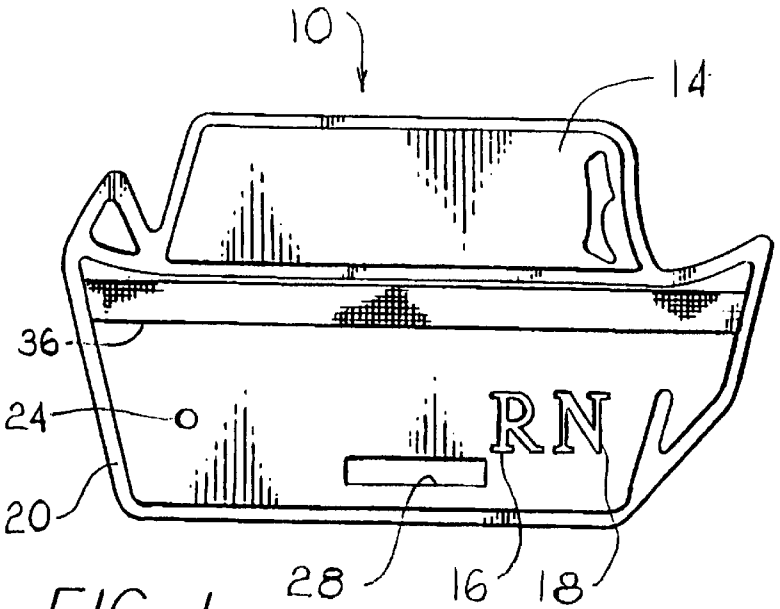
FIG. 1 is a front elevational view of the identification badge holder.
Figure 7:
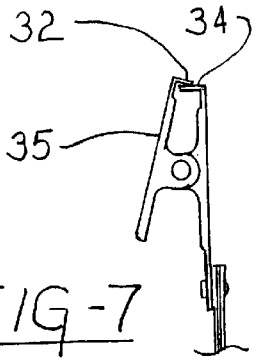
FIG. 7 is a side elevational view of a clothespin type device.
Figure 5:
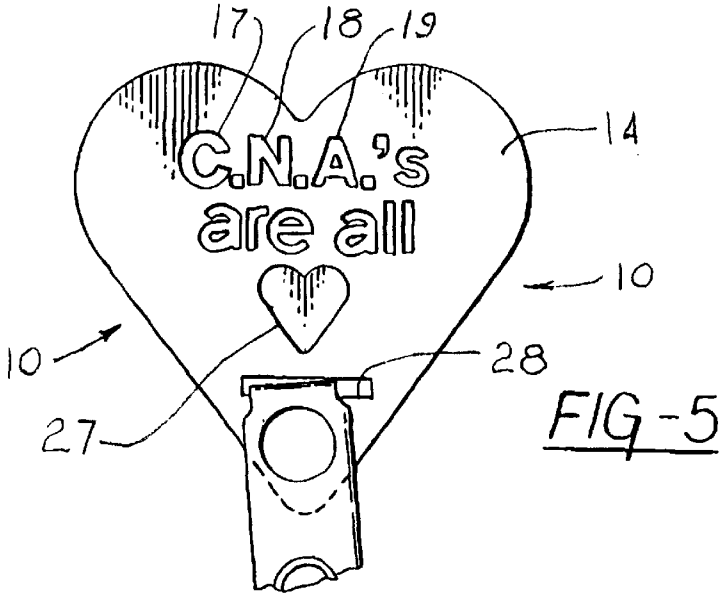
FIG. 5 is a front elevational view of an identification badge holder with a different shape and an identification badge with portions broken away.
Figure 6:
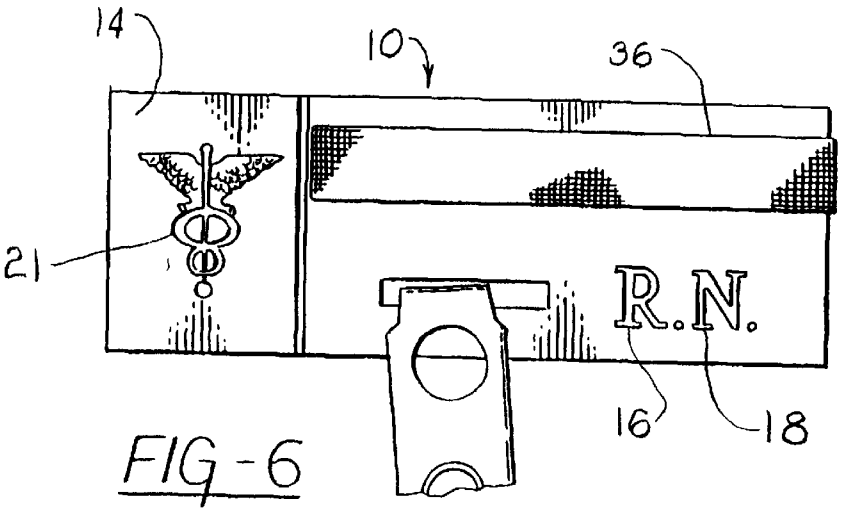
FIG. 6 is a front elevational view of an identification badge holder with a different shape and an identification badge with portions broken away.
Figure 4:
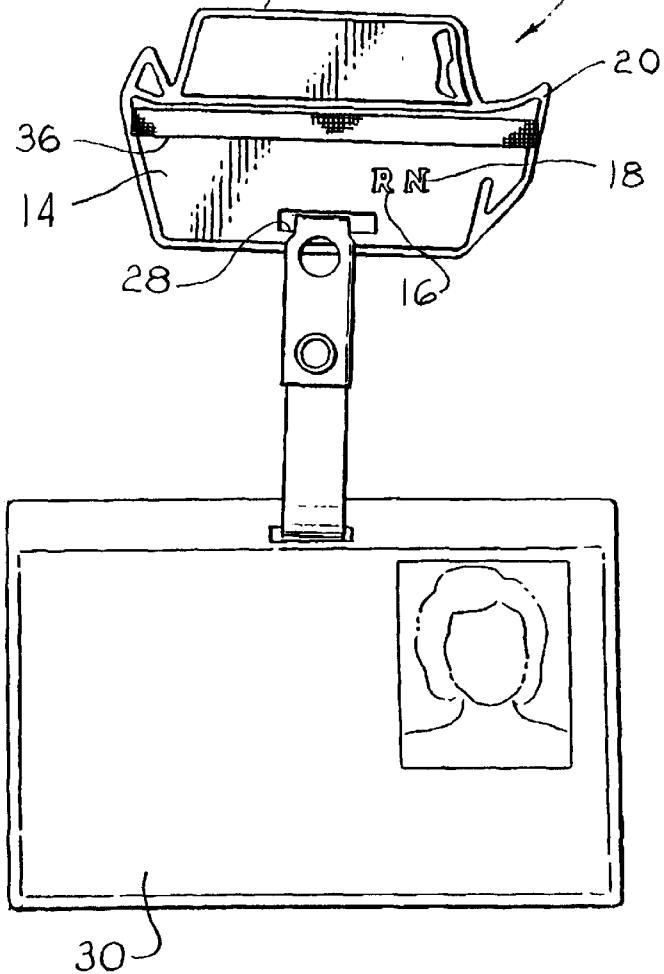
FIG. 4 is a front elevational view of the identification badge holder with an identification badge attached.

The identification badge holder 10 as shown in FIGS. 1, 2 and 4 is in the shape of a nurse's cap. When used for other professions, the shape is changed. The badge holder 10 is made from a plastic base plate 12 and a plastic face plate 14. The face plate 14 is secured to the base 12 by an adhesive. Portions of the face plate 14 are removed by a milling machine to expose the base plate 12, to form an edge with contrasting colors, to provide depth and to form letters 16, 17, 18, and 19 which represent the professional qualifications. The base plate 12 and the face plate 14 have contrasting colors so that the letters 16, 17, 18, and 19 stand out. The border 20 with contrasting colors makes the nurses cap recognizable from a distance. More than two letters can be used to represent the professional qualifications if necessary. Symbols such as a caduceus 21 can also be created by removing a portion of the face plate 14 if desired.

A one or two prong clutch back retainer 22 is attached to the rear surface of the base plate 12. One or two prongs 23 of the clutch back retainer 22 passes through fabric and clutch members 25 slide onto the prongs and lock the badge holder in place. The retainer 22 holds the badge holder 10 securely to fabric clothing without damaging the fabric. However, a safety pin type fastener could also be used if desired in place of the clutch back retainer 22. With a one prong 23 clutch back retainer 22, the badge holder may pivot about the axis of the prong.

Apertures 24 and 26 are provided in the badge holder 10 for the attachment of a college or university pin, a union pin or a decorative pin 27 for example. The apertures 24 and 26 as shown in FIG. 2 will not accommodate all such pins 27.

The apertures 24 and 26 will need to be vertically disposed rather than horizontally disposed as shown for some pins 27. Only one aperture will be required for some pins. There are other pins 27 that require a retainer system other than apertures. These pins could be attached by adhesives, a hook and loop fastening system, by snaps, or by another suitable securing system. If necessary, a plastic or cloth sheet can be attached to the badge holder 10 by one securing system and a separate securing system can be used to attach a pin to the sheet.

The badge holder 10 has a shape or markings indicating professional qualifications that can be identified at a distance of 10 feet or more. This permits the public, security personnel and fellow workers make a partial identification well before they can see a photograph on an identification badge 30 or identify any other markings on the identification badge.

A slot 28 through the badge holder 10 is provided for the attachment of an identification badge 30. The slot 28 receives the overlapping clamp end members 32 and 34 of a clothespin type device 35 commonly used on identification badges 30. The badge holder 10 can be modified for the attachment of badges 30 that have an attaching system other than a clothespin type device 35.

A colored fabric bar 36, like the ones that are sewn to the edge of nurses caps, is attached to the face plate portion 14 of the badge holder 10 if desired.

An alternate construction for the badge holder 10 is a one piece plastic member rather than the base plate 12 and the face plate 14. The letters and symbols can be attached to the front surface of the one piece plate member. Letters and symbols can also be formed in the surface by a milling machine or other suitable forming machine and then painted or filled in by a material with a contrasting color.

The disclosed embodiment is representative of a presently preferred form of the invention, but is intended to be illustrative rather than definitive thereof. The invention is defined in the claims.

I claim:

1. An identification badge holder comprising a base plate; a face plate attached to the base plate; passages through the face plate that expose the base plate and form indicia that indicate the profession of a person; a clutch back retainer secured to a side of the base plate opposite the face plate for attaching the identification badge holder to a garment; a slot, through the base plate and the face plate, adjacent to a lower edge of the base plate; and an identification badge with individual identification information and an integral attaching device with at least one end member that passes into the slot through the base plate and the face plate to secure the identification badge to the identification badge holder.

2. An identification badge holder as set forth in claim 1 including at least one aperture through the base plate and the face plate for attaching a pin to the face plate.

3. An identification badge holder as set forth in claim 1 wherein the clutch back retainer has two prongs that project through a garment and a clutch member on each prong that holds the prong in the garment.

4. An identification badge holder comprising:

a plate member with a back side, a face side and edges;

indicia on the face side that indicates the profession of a person;

a retainer member on the back side of the plate member for attaching the badge holder to clothing;

a slot through the plate member adjacent to one of the edges for attaching and holding an identification badge; and wherein the plate member includes a base plate and a face plate and some of the indicia on the face side is formed by removing a portion of the face plate to expose the base plate.

5. An identification badge holder in combination with an identification badge comprising:

a badge holder plate member with a badge holder back side, a badge holder face side and a plurality of badge holder edges including a bottom edge;

an indicia on the badge holder face side that indicates the profession of a person;

a badge holder retainer on the badge holder back side for attaching the badge holder plate member to clothing;

an elongated slot through the badge holder plate member adjacent to said bottom edge that forms a bar between the elongated slot and the bottom edge; and wherein said identification badge has an identification card with a card front side, a card back side, a clamp device attached to the identification card and having at least one blade member that is received in the elongated slot of said identification badge holder, engages the bar and limits rotation of the identification card about a generally vertical axis to keep the card front side facing in substantially the same direction as the badge holder face side.

6. An identification badge holder in combination with an identification badge as set forth in claim 5 wherein the plurality of badge holder edges form a nurse's cap silhouette.

7. An identification badge holder in combination with an identification badge as set forth in claim 5 wherein said bar cooperates with the clamp device to permit pivotal movement of the clothespin type device relative to said identification badge about a generally horizontal axis.

* * * * *